United States Patent [19]

Escue

[11] 4,093,143

[45] June 6, 1978

[54] STOCK WINDING APPARATUS

[76] Inventor: Jesse W. Escue, 314 Nicholson, Joliet, Ill. 60435

[21] Appl. No.: 786,149

[22] Filed: Apr. 11, 1977

[51] Int. Cl.[2] ..... B65H 59/00

[52] U.S. Cl. ..... 242/75.51; 242/25 R; 242/78.1; 242/158.5

[58] Field of Search ..... 242/75.51, 78.1, 71.9, 242/158 R, 158.2, 158.5, 25 R, 115, 116, 117

[56] References Cited

U.S. PATENT DOCUMENTS

| | | | |
|---|---|---|---|
| 1,518,402 | 12/1924 | Feigelman | 242/71.9 |
| 2,845,229 | 7/1958 | Bliss | 242/25 R |
| 2,964,971 | 12/1960 | Blydenburgh | 242/158.5 X |
| 2,971,721 | 2/1961 | Jones | 242/115 X |
| 3,412,948 | 11/1968 | Fahrbach | 242/25 R |
| 3,413,834 | 12/1968 | Kovaleski | 242/25 R X |
| 3,565,357 | 2/1971 | Noguchi | 242/25 R |

*Primary Examiner*—Edward J. McCarthy
*Attorney, Agent, or Firm*—Hosier, Niro & Daleiden, Ltd.

[57] ABSTRACT

An apparatus for winding stock in coil fashion. The apparatus includes a base, a variable speed motor, a speed selection control unit, a coil guide, and clutch means. The variable speed motor is mounted on the base and operatively joined through a first gear box to a drive shaft equipped with a reel for taking up the stock. The speed selection control unit regulates the speed of the motor having monitoring means responsive to movement of the stock at a point remote from the reel. The monitoring means instantaneously signals the motor to slow in response to momentary slight increases in the speed of the stock at the remote point as the diameter of the stock on the reel builds to maintain the speed of the stock at the selected speed on the control unit. The coil guide is operatively joined through a second gear box to the first gear box for rotation and reciprocation to direct the stock onto the reel being carried on a support shaft linked to the second gear box through reciprocal camming means. The clutch means selectively engages and disengages the motor and the first gear box. With these features of construction, the apparatus is adapted to direct the stock onto the reel in side-by-side coil fashion at the selected speed.

15 Claims, 3 Drawing Figures

STOCK WINDING APPARATUS

BACKGROUND

The present invention relates to winders and, more particularly, to an apparatus for winding stock in side-by-side coil fashion.

A winder generally includes means for transferring stock, means for rotating a reel for winding stock, and guide means reciprocating in the direction of the reel axis to guide the winding of stock onto the reel. The traverse of the guide means has been accomplished in numerous ways such as by a cam, a lead screw with reversed rotations, or an endless belt. For successive winding of stock onto the reel, the traverse of the guide means relative to the reel must be cooperatively associated with the winding action of the reel. However, the speed of stock approaching the reel becomes high if the reel is rotated at a fixed speed since the thickness of the stock wound on the reel in the form of layers becomes large as the stock winding operation progresses. For this reason, means must be provided for slowing the rotation of the reel in order to avoid an increase of the speed of the stock approaching the reel and the traverse of the guide means must also be responsive to the means for slowing the reel.

While the above holds true for winding wire stock in coil fashion, it is far more critical in operations in which coil winding of flat or strip stock would be advantageous. It will be appreciated that coil winding flat or strip stock requires the stock to lay nearly perfectly in side-by-side coil fashion on the reel. In contrast, wire stock will simply find its own slot in the event that the winding operation is less than completely accurate. It has been found that no prior coil winder is capable of successively coil winding flat or strip stock in the required manner. With all coil winders heretofore available, the winding of flat or strip stock is not even suggested which is understandable in view of the limited cooperative accuracy in the relationship between the winding action of the reels and the traversing action of the guide means achievable with such prior art devices.

Without complete cooperative accuracy between the reels and the guide means, the failure of prior art coil winders to disclose or suggest winding flat or strip stock is not surprising. It is readily apparent that the flat or strip stock will either overlap or bind or produce too large a gap between succeeding coils should precisely accurate winding not be maintained. In the former case, there will be undesirable kinks or other imperfections in the stock caused by the winding operation while in the latter case there will be an insufficient amount of stock wound on the reel with the possibility of kinks or other imperfections on the next succeeding layer of the stock caused by the gaps either of which are highly objectionable. It has previously not been possible to successfully coil wind flat or strip stock so that it will lay nearly perfectly in side-by-side coil fashion on the reel. However, I have developed an apparatus which accomplishes these and other objectives in a most advantageous manner.

While those skilled in the art may have long been aware of the problems associated with successfully coil winding flat or strip stock, the subsequent development of satisfactory apparatus has not followed. In this and similar fields, coil winders have become somewhat more sophisticated in recent years such as those disclosed in U.S. Pat. Nos. 3,565,357, 3,413,834, 3,412,948 and 3,402,903 wherein the coil winders disclosed represent attempted improvements of limited success. While those skilled in the art have failed, I have provided an apparatus that for the first time represents a significant advance fully overcoming the problems previously believed to be inherent in winding stock to lay nearly perfectly in side-by-side coil fashion on the reel.

SUMMARY

The present invention is directed to an apparatus for winding stock in coil fashion. It includes a base, a variable speed motor, a speed selection control unit, a coil guide, and clutch means. The variable speed motor is mounted on the base and operatively joined through a first gear box to a drive shaft equipped with a reel for taking up the stock. The speed selection control unit regulates the speed of the motor having monitoring means responsive to movement of the stock at a point remote from the reel. The monitoring means instantaneously signals the motor to reduce its speed in response to momentary slight increases in the speed of the stock at the remote point as the diameter of the stock on the reel builds to maintain the speed of the stock at the selected speed on the control unit. The coil guide is operatively joined through a second gear box to the first gear box for rotation and reciprocation to direct the stock onto the reel being carried on a support shaft linked to the second gear box through reciprocal camming means. The clutch means selectively engages and disengages the motor and the first gear box. With these features of construction the apparatus is adapted to direct the stock onto the reel in side-by-side coil fashion at the selected speed.

In the preferred embodiment, the monitoring means is a toothed gear counter using electrical current to count pulses. It is preferably connected to a stock guide on another machine or the like at the remote point. The control unit converts the speed of the toothed gear counter from revolutions per minute to feet per minute.

The stock can be either wire stock or flat stock having a width greater than its thickness. It is in the later case that the apparatus is particularly advantageous with the coil guide being inwardly and outwardly adjustable to assure the flat stock being directed onto the reel in side-by-side coil fashion. The coil guide is also inwardly and outwardly adjustable to permit selection of the width of the finished coil.

The reel is adjustable to permit selection of the width and inner diameter of the coil wound on the reel. It includes a collapsible and expandable drum having a slot therein and having front and rear end plates thereon. The front end plate is removable to permit binding and removal of the stock after the coil has been wound onto the reel.

The coil guide includes means for locking the guide against reciprocation for winding the stock in ribbon fashion. The stock can be taken up on the reel so as to have an inner diameter to outer diameter ratio on the order of 3:1 with only a ½ of 1% variation from the selected speed on the control unit. The reel can be driven by the motor through the first gear box and the drive shaft in either a clockwise direction or counterclockwise direction for winding or unwinding the stock.

The present invention retains the advantages inherent in coil winders while at the same time providing an improved apparatus that significantly enhances the desirability of such winders. It is therefore an object of the present invention to provide an apparatus for winding stock to lay nearly perfectly in side-by-side coil fashion on a reel where the stock is wound at a constant selected speed, the apparatus being highly effective in operation providing precisely accurate winding for flat stock as well as wire. The provision of the structure and the realization of the advantages to be derived therefrom constitute additional important objects of the present invention with still other objects to be appreciated from a consideration of the details of construction and operation set forth in the accompanying specification, claims and drawings.

DRAWINGS

The present invention is described in conjunction with the accompanying drawings in which FIG. 1 is a perspective view of the apparatus for winding stock in coil fashion in accordance with the present invention;

DESCRIPTION

Figure 1:
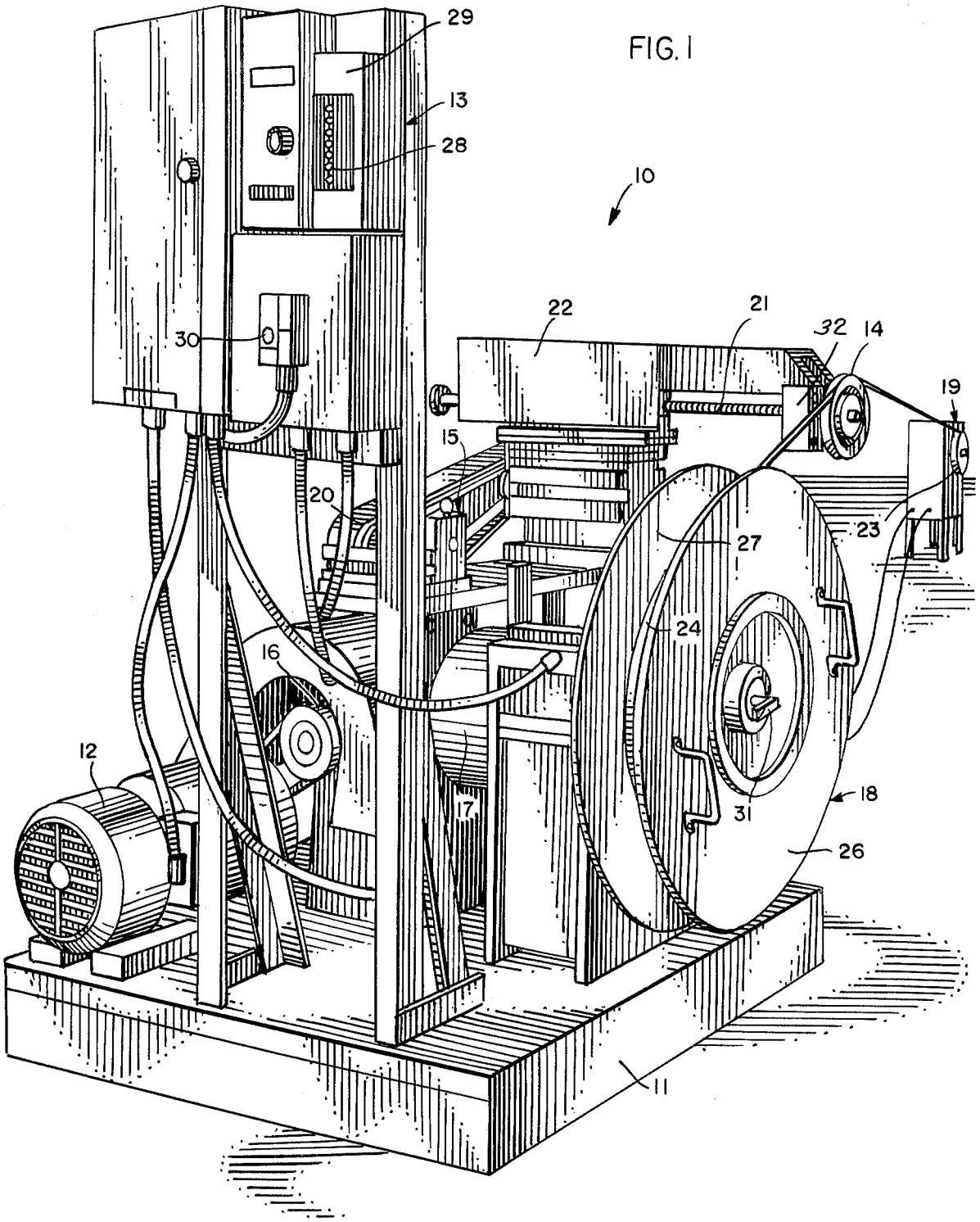
Figure 3:
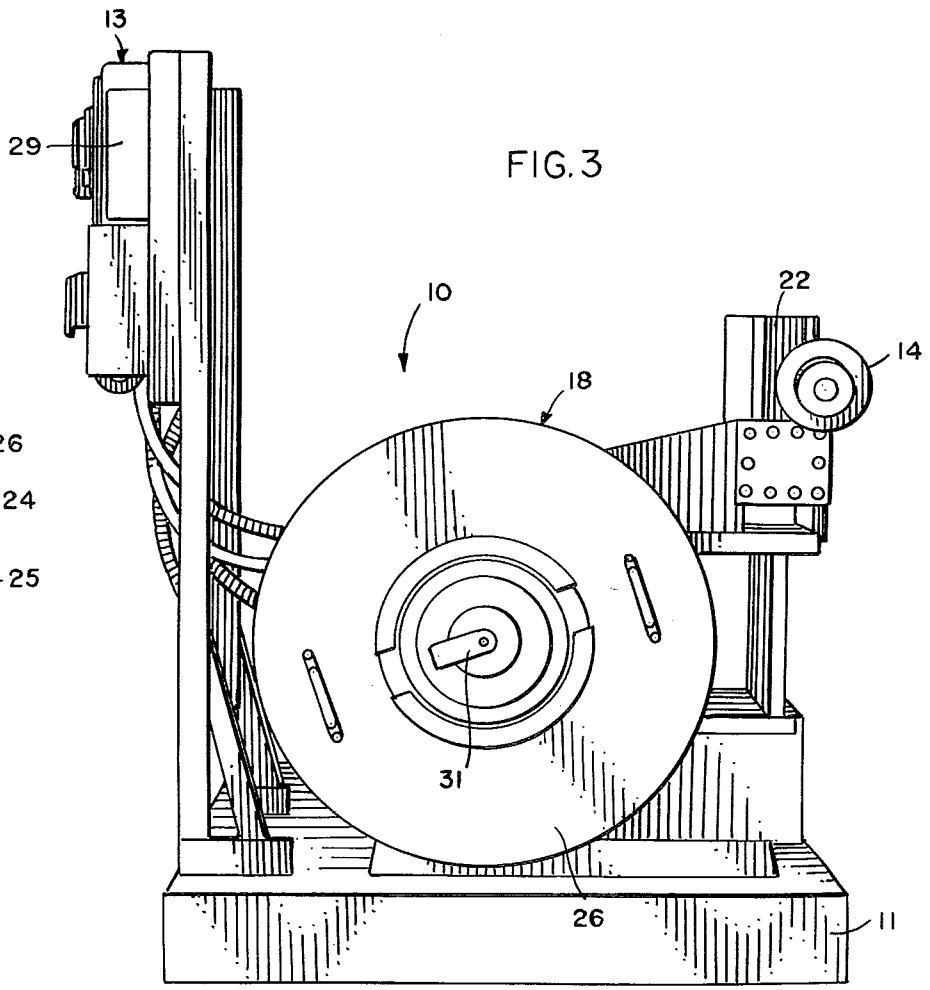
FIG. 3 is a side elevational view of the apparatus of FIG. 1.

In the illustration given and with reference first to FIG. 1, the numeral 10 designates generally an apparatus for winding stock in coil fashion in accordance with the present invention. The apparatus 10 includes a base 11, a variable speed motor 12, a speed selection control unit 13, a coil guide 14, and clutch means 15. The variable speed motor 12 is mounted on the base 11 being operatively joined through a first gear box 16 to a drive shaft 17 equipped with a reel 18 for taking up the stock. The speed selection control unit 13 regulates the speed of the motor 12 having monitoring means 19 responsive to movement of the stock at a point remote from the reel 18. The monitoring means 19 instantaneously signals the motor 12 to reduce its speed in response to momentary slight increases in the speed of the stock at the remote point as the diameter of the stock on the reel 18 builds in order to maintain the speed of the stock at the selected speed of the control unit 13. The coil guide 14 is operatively joined through a second gear box 20 to the first gear box 16 for rotation and reciprocation to direct the stock onto the reel 18 being carried on a support shaft 21 linked to the second gear box 20 through reciprocal camming means within 22. The clutch means 15 permits the user to selectively engage and disengage the motor 12 and the first gear box 16. With these features of construction the apparatus 10 is adapted to direct the stock onto the reel 18 to lay nearly perfectly in side-by-side coil fashion at the selected speed.

The monitoring means 19 is a toothed gear counter using electrical current to count pulses. It is connected to a stock guide 23 attached to a machine or the like at the remote point. The control unit 13 converts the speed of the toothed gear counter 19 from revolutions per minute to feet per minute.

The stock can advantageously be flat stock having a width greater than its thickness. The coil guide 14 is inwardly and outwardly adjustable to assure that the flat stock is directed onto the reel 18 to lay nearly perfectly in side-by-side coil fashion. The coil guide 14 is also inwardly and outwardly adjustable to permit selection of the width of the finished coil.

Figure 2:
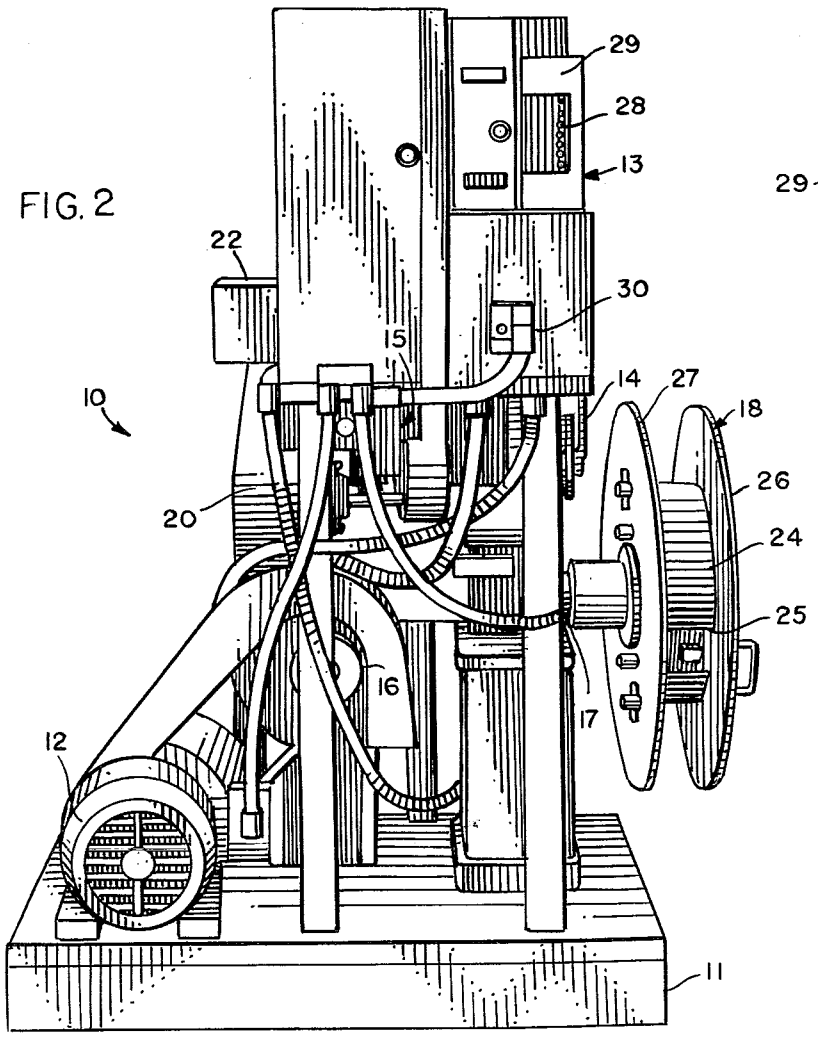
FIG. 2 is a front elevational view of the apparatus of FIG. 1.

The reel 18 is adjustable to permit selection of the width and inner diameter of the coil wound on the reel 18. It includes a collapsible and expandable drum 24 (as shown in FIG. 2) having a slot 25 therein and having front and rear end plates 26 and 27 thereon. The front end plate 26 is removable to permit binding and removal of the stock after the coil has been wound onto the reel 18.

The coil guide 14 includes conventional means 32 for locking the guide against reciprocation for winding the stock in ribbon fashion. The stock can be taken up on the reel 18 into a coil having an inner diameter to outer diameter ratio on the order of 3:1 with only a ½ of 1% variation from the selected speed on the control unit 13. The reel 18 can be driven by the motor 12 through the first gear box 16 and the drive shaft 17 in either a clockwise or counter-clockwise direction for winding or unwinding the stock.

With the apparatus 10, I have provided an improved mechanical oscillating or traversing coil winder. It is capable of coil winding any size flat stock or wire stock on the reel 18 although it can also ribbon wind in conventional fashion. By coil winding flat stock, the apparatus 10 can produce four to six times more stock on the reel 18 than was previously possible since flat stock heretofore had to be conventionally ribbon wound. It is reversible so either flat stock or wire stock can be wound or unwound in either direction. As a result, the apparatus 10 can be used to wind stock onto the reel 18 and can also be used to unwind stock from the reel 18 behind a machine, e.g., a punch press or the like.

The apparatus 10 can be preset so that the stock approaching the reel 18 will travel at a constant speed in feet per minute despite the continually increasing diameter of the coil with the angular velocity of the reel 18 slowing in response to momentary slight increases in the speed of the stock. The stock is initially locked to the drum 24 by means such as a screw. The speed selection control unit 13 can then be set to a constant speed in feet per minute ranging from 100 feet per minute on upward by engaging a corresponding push button 28 located on a programmed panel 29. The clutch means or safety clutch 15 can then be disengaged for engagement of the motor 12 and the first gear box 16. The reel 18 will start winding the stock onto the drum 24 as soon as a start button 30 is engaged. When this has been done the apparatus 10 will wind the stock onto the reel 18 to lay nearly perfectly in side-by-side coil fashion at the selected speed.

By engaging the start button 30 with the clutch means 15 disengaged, the motor 12 begins to run. The motor 12 drives the reel 18 through the first gear box 16 and the drive shaft 17. It also causes the coil guide 14 to rotate and reciprocate since the coil guide 14 is operatively joined through the second gear box 20 to the first gear box 16. The motor 12 therefore not only drives the reel 18 to wind the stock but also drives the coil guide 14 to direct the stock as it rotates and reciprocates. Since the coil guide 14 is inwardly and outwardly adjustable, the apparatus 10 can be set to wind so that the stock will lay nearly perfectly in side-by-side coil fashion.

The apparatus 10 will continue to wind the stock onto the reel 18 at the selected speed until the reel 18 has been filled at which point the apparatus 10 will automatically shut off and reset so that it cannot be engaged again until it is desired to start a new coil. The front end plate 26 can then be removed by unscrewing a center handle 31 that also collapses the drum 24, turning the front end plate 26 90° to align slots in the end plate 26 with fingers on th drum 24, and pulling the front end plate 26 away from the drum 24 and the shaft 17. When this has been done, the stock can be unlocked from the reel by backing out the locking screw on the drum 24 and banding the coil through the slot 25 after which the coil can be removed from the drum 24 and the drive shaft 17 ready for shipment.

If it is desired to ribbon wind the stock, the coil guide 14 is simply locked by conventional means 32. In doing so, the coil guide 14 can still rotate to direct stock onto the reel 18 but it cannot reciprocate. This means that the stock will be taken up on the reel 18 in conventional ribbon fashion. In order to switch to coil winding, the conventional locking means 32 of the coil guide 14 need only be unlocked so that it can again reciprocate. With these features of construction, the apparatus 10 presents maximum versatility since it is capable of winding or unwinding in ribbon fashion or coil fashion with flat stock or wire stock in coils of varying width and diameter.

I have found that the apparatus 10 is capable of producing coils having an outer diameter to inner diameter ratio on the order of 3:1 with a speed variation of no more than ½ of 1%. The apparatus 10 is therefore capable of producing rather large coils of stock at almost constant speed. In contrast, prior art winders are usually not capable of producing coils of greater than a 2:1 outer diameter to inner diameter ratio and then with no less than a 5% speed variation. The apparatus 10 accurately controls the speed of the stock with the speed selection control unit 13 and the relative winding positions of the stock with the coil guide 14 to successfully wind flat stock onto the reel 18 to lay nearly perfectly in side-by-side coil fashion. While this has long been a goal of those skilled in the art, the apparatus 10 of my invention is the first coil winder capable of the precisely accurate winding necessary to wind flat stock onto a reel without overlapping or leaving excessive gaps.

The present invention is therefore well suited for winding stock onto a reel to lay nearly perfectly in side-by-side coil fashion at a constant selected speed achieving this objective by providing a unique speed selection control unit and coil guide that are operationally interconnected. The monitoring means of the speed selection control unit instantaneously signals the motor through the control unit to slow in response to momentary slight increases in the speed of the stock at a remote point long before the stock actually reaches the reel. In turn, the slowing of the motor slows the reel through the first gear box and it also slows the coil guide through the first and second gear boxes meaning that the coil guide rotation and reciprocation and the rotation of the reel are directly and immediately responsive to momentary slight increases in the speed of the stock at the remote point. The monitoring means at the remote point is therefore responsible for maintaining the speed of the stock at the speed selected on the control unit with the benefit of a completely coordinated response from all of the operative elements of the apparatus 10. The present invention is thereby successful for the first time in providing an apparatus for winding flat stock onto a reel in precisely accurate side-by-side coil fashion at a constant speed.

While in the foregoing specification a detailed description of the invention has been set forth for purposes of illustration, it will be appreciated by those skilled in the art that the details herein given may be varied without departing from the spirit and scope of the invention.

I claim:

1. An apparatus for winding stock in coil fashion comprising a base, a variable speed motor mounted on said base, said motor operatively joined through a first gear box to a drive shaft equipped with a reel for taking up said stock, a speed selection control unit for regulating the speed of said motor having monitoring means responsive to movement of said stock at a point remote from said reel, said monitoring means instantaneously signalling said motor to reduce its speed in response to momentary slight increases in the speed of said stock at said remote point as the diameter of said stock on said reel builds to maintain the speed of said stock at the selected speed on said control unit, a coil guide operatively joined through a second gear box to said first gear box for rotation and reciprocation to direct said stock onto said reel, said coil guide being carried on a support shaft linked to said second gear box through reciprocal camming means, and clutch means for selectively engaging and disengaging said motor and said first gear box whereby said apparatus is adapted to direct said stock onto said reel in side-by-side coil fashion at the selected speed.

2. The apparatus of claim 1 in which said monitoring means is a toothed gear counter.

3. The apparatus of claim 2 in which said toothed gear counter uses electrical current to count pulses.

4. The apparatus of claim 2 in which said toothed gear counter is connected to a stock guide at said remote point.

5. The apparatus of claim 2 in which said control unit converts the speed measured by said toothed gear counter from revolutions per minute to feet per minute.

6. The apparatus of claim 1 in which said stock is flat stock having a width greater than its thickness.

7. The apparatus of claim 6 in which said coil guide is inwardly and outwardly adjustable to assure said flat stock being directed onto said reel in side-by-side coil fashion.

8. The apparatus of claim 7 in which said coil guide can be accurately adjusted to provide a gap between adjacent coils of said flat stock on the order of one-sixteenth inch.

9. The apparatus of claim 1 in which said coil guide is inwardly and outwardly adjustable to permit selection of the width of said coil of said stock.

10. The apparatus of claim 1 in which said reel is adjustable to permit selection of the width and inner diameter of said coil wound on said reel.

11. The apparatus of claim 1 in which said reel includes a collapsible and expandable drum having front and rear end plates thereon.

12. The apparatus of claim 11 in which said drum includes a slot and at least said front end plate is removable to permit binding and removal of said stock after said coil has been wound on said reel.

13. The apparatus of claim 1 in which said coil guide includes means for locking said guide against reciprocation for winding said stock in ribbon fashion.

14. The apparatus of claim 1 in which said stock can be taken up on said reel into a coil having an outer diameter ratio to inner diameter ratio on the order of 3:1 with only a ½ of 1% variation from the selected speed on said control unit.

15. The apparatus of claim 1 in which said reel can be driven by said motor through said first gear box and said drive shaft in either a clockwise direction or counter-clockwise direction for winding or unwinding said stock.

* * * * *